US007602299B2

(12) United States Patent
Valade, Jr. et al.

(10) Patent No.: US 7,602,299 B2
(45) **Date of Patent: *Oct. 13, 2009**

(54) SECURITY TAG HAVING A LINEAR CLAMP

(75) Inventors: Franklin H. Valade, Jr., Lake Worth, FL (US); John R. B. Chamberlain, Boca Raton, FL (US); Dennis L. Hogan, Lighthouse Point, FL (US); Thang T. Nguyen, Boca Raton, FL (US)

(73) Assignee: Sensormatic Electronics Corporation, Boca Raton, FL (US)

( * ) Notice: Subject to any disclaimer, the term of this patent is extended or adjusted under 35 U.S.C. 154(b) by 545 days.

This patent is subject to a terminal disclaimer.

(21) Appl. No.: 10/612,750

(22) Filed: Jul. 2, 2003

(65) Prior Publication Data

US 2005/0001726 A1 Jan. 6, 2005

(51) Int. Cl.
*G08B 13/14* (2006.01)

(52) U.S. Cl. ..... 340/572.8; 340/572.9

(58) Field of Classification Search ..... 340/572.1, 340/571, 572.8, 572.9, 568.1; 24/704.1
See application file for complete search history.

(56) References Cited

U.S. PATENT DOCUMENTS

| | | | | |
|---|---|---|---|---|
| 4,745,664 | A * | 5/1988 | Damvig | 24/704.1 |
| 4,774,504 | A * | 9/1988 | Hartings | 340/572.5 |
| 5,426,419 | A * | 6/1995 | Nguyen et al. | 340/572.9 |
| 6,373,390 | B1 | 4/2002 | Hogan et al. | |
| 6,474,117 | B2 * | 11/2002 | Okuno | 70/57.1 |
| 7,084,766 | B2 * | 8/2006 | Sayegh et al. | 340/572.1 |
| 2002/0024440 | A1 | 2/2002 | Okuno | |
| 2003/0222780 | A1 * | 12/2003 | Sayegh et al. | 340/572.9 |
| 2004/0239505 | A1 * | 12/2004 | Hogan et al. | 340/572.9 |

OTHER PUBLICATIONS

European Search Report, Application No. EP04014218, Date of Completion of the Search: Nov. 17, 2004, pp. 1-2.

* cited by examiner

*Primary Examiner*—Thomas J Mullen
(74) *Attorney, Agent, or Firm*—Kacvinsky LLC

(57) ABSTRACT

Techniques for linear release for a security tag are described.

44 Claims, 10 Drawing Sheets

SECURITY TAG HAVING A LINEAR CLAMP

BACKGROUND

An Electronic Article Surveillance (EAS) system is designed to prevent unauthorized removal of an item from a controlled area. A typical EAS system may comprise a monitoring system and one or more security tags. The monitoring system may create a surveillance zone at an access point for the controlled area. A security tag may be fastened to the monitored item, such as an article of clothing. If the monitored item enters the surveillance zone, an alarm may be triggered indicating unauthorized removal.

The security tag may be fastened to a number of different items. It may be desirable for the fastening system to allow authorized release of the security tag, while making unauthorized release relatively difficult. Consequently, there may be a need for improved techniques in security tags in general, and fastening systems for security tags in particular.

BRIEF DESCRIPTION OF THE DRAWINGS

The subject matter regarded as embodiments of the invention is particularly pointed out and distinctly claimed in the concluding portion of the specification. Embodiments of the invention, however, both as to organization and method of operation, together with objects, features, and advantages thereof, may best be understood by reference to the following detailed description when read with the accompanying drawings in which:

DETAILED DESCRIPTION

Embodiments of the invention may be directed to techniques for attaching and detaching a security tag. For example, one embodiment of the invention may comprise a security tag having a tag housing, tack body and linear clamp. To attach the security tag to an item, such as an article of clothing, the tack body may be inserted through the article of clothing and into a hole in the tag housing. The linear clamp may be disposed within the tag housing to receive and retain the tack body, thereby completing the attachment process. To detach the security tag, a detachment device having a detachment probe may be used to apply force to the linear clamp. The force may move the linear clamp in a substantially linear direction to release the tack body from the linear clamp. The term "linear" as used herein may refer to movement in any particular direction along a substantially straight line, although the embodiments are not limited in this context. Once the tack body has been released from the linear clamp, the tack body may be removed from the tag housing to detach the security tag from the item.

It is worthy to note that any reference in the specification to "one embodiment" or "an embodiment" means that a particular feature, structure, or characteristic described in connection with the embodiment is included in at least one embodiment of the invention. The appearances of the phrase "in one embodiment" in various places in the specification are not necessarily all referring to the same embodiment.

Numerous specific details may be set forth herein to provide a thorough understanding of the embodiments of the invention. It will be understood by those skilled in the art, however, that the embodiments of the invention may be practiced without these specific details. In other instances, well-known methods, procedures and components have not been described in detail so as not to obscure the embodiments of the invention. It can be appreciated that the specific structural and functional details disclosed herein may be representative and do not necessarily limit the scope of the invention.

Figure 1:
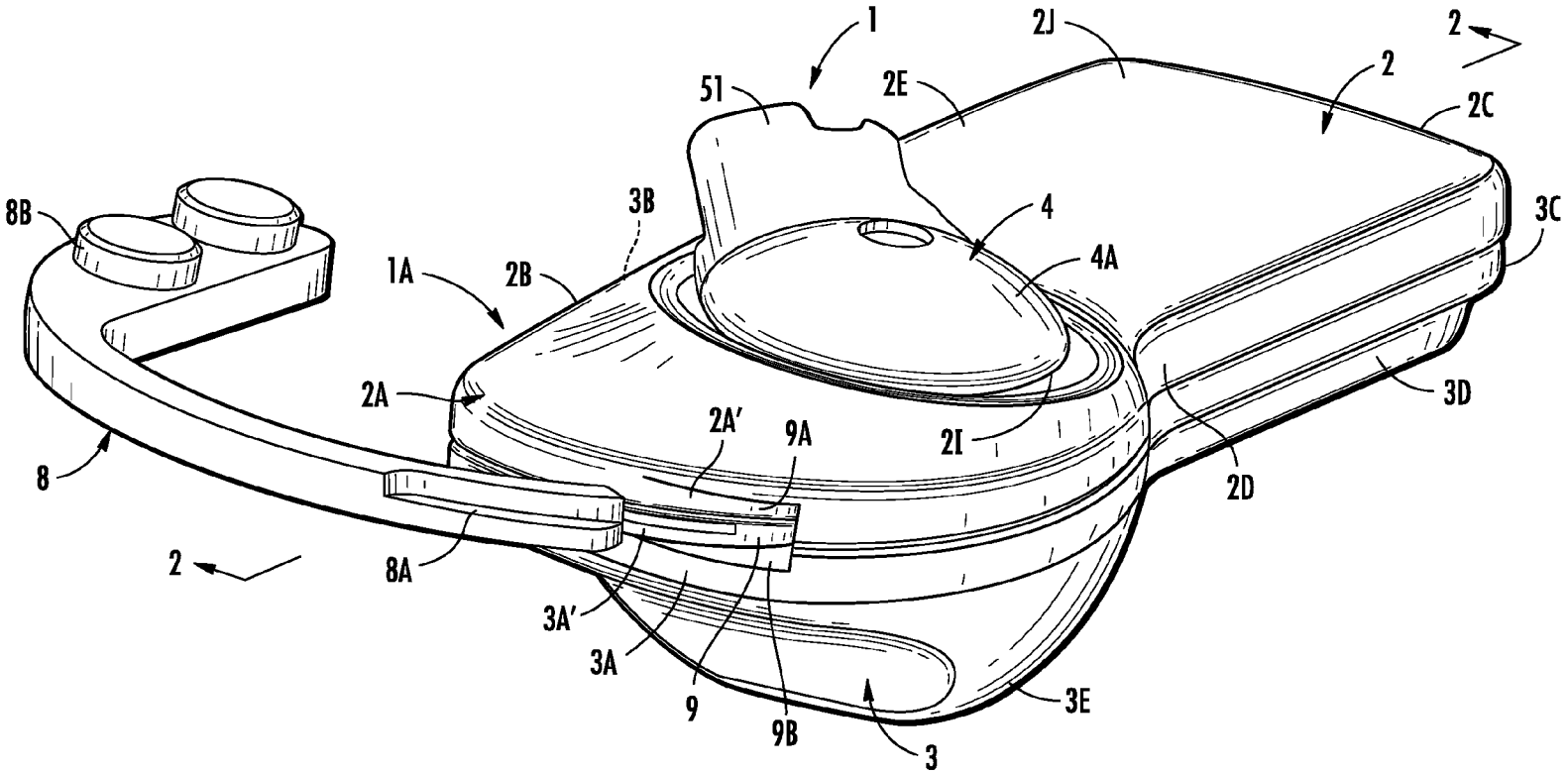
FIG. 1 illustrates a security tag in accordance with one embodiment of the invention.

Referring now in detail to the drawings wherein like parts are designated by like reference numerals throughout, there is illustrated in FIG. 1 a security tag in accordance with one embodiment of the invention. In one embodiment, FIG. 1 illustrates a security tag 1 that includes an upper housing 2 having side walls 2A, 2B, 2C and 2D, all of which are joined by a top wall 2E. Security Tag 1 also includes a lower housing 3 having side walls 3A, 3B, 3C and 3D, which are joined by a bottom wall 3E. The upper and lower housings 2 and 3 are joined or mated along corresponding or associated side wall pairs (2A, 3A), (2B, 3B), (2C, 3C) and (2D, 3D) to form a closed tag body 1A.

In one embodiment, housings 2 and 3 are made of a hard or rigid material. A usable rigid or hard material might be a hard plastic such as, for example, an injection molded ABS plastic. If a plastic is used, the mating side walls of the housings can be joined by an ultrasonic weld 1B of FIG. 2 or like joining mechanism.

Figure 2:
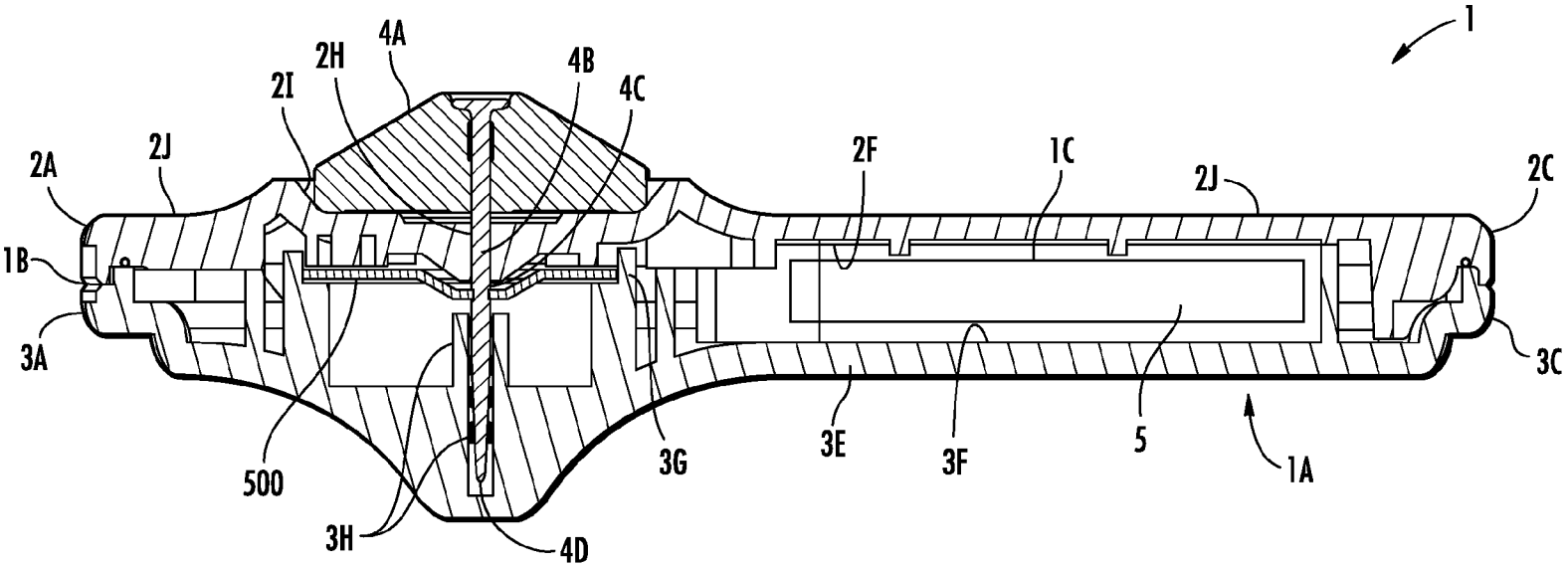
FIG. 2 illustrates a cross-section of the security tag in FIG. 1 taken along the line A-A in accordance with one embodiment of the invention.

Security tag 1 may further include a tack assembly 4 shown as having an enlarged tack head 4A and an elongated tack body 4B provided with slots or grooves 4C and a pointed forward end 4D, as shown in FIG. 2. Tack assembly 4 may be used to attach the tag body 1A to an article 51 that is to be protected by security tag 1. In this embodiment, article 51 may comprise, for example, an article of clothing.

FIG. 2 illustrates a cross-section of the security tag in FIG. 1 taken along the line A-A in accordance with one embodiment of the invention. In order to sense security tag 1 and, therefore, detect the presence of the tag and the attached article 51, inner surfaces 2F and 3F of the walls 2E and 3E of the housings 2 and 3 are provided with frame members 2G and 3G which together define an interior cavity 1C for receiving an EAS sensor 5. EAS sensor 5 generates detectable signals and can be an acoustically resonant magnetic sensor, as disclosed in U.S. Pat. No. 4,510,489 and U.S. Pat. No. 4,510,490. Possible other magnetic EAS sensors suitable for sensor 5 might be those disclosed in U.S. Pat. No. 4,686,516 and U.S. Pat. No. 4,797,658, while possible representative radio-frequency (RF) EAS sensors might be those disclosed in U.S. Pat. No. 4,429,302 and U.S. Pat. No. 4,356,477.

Figure 3:
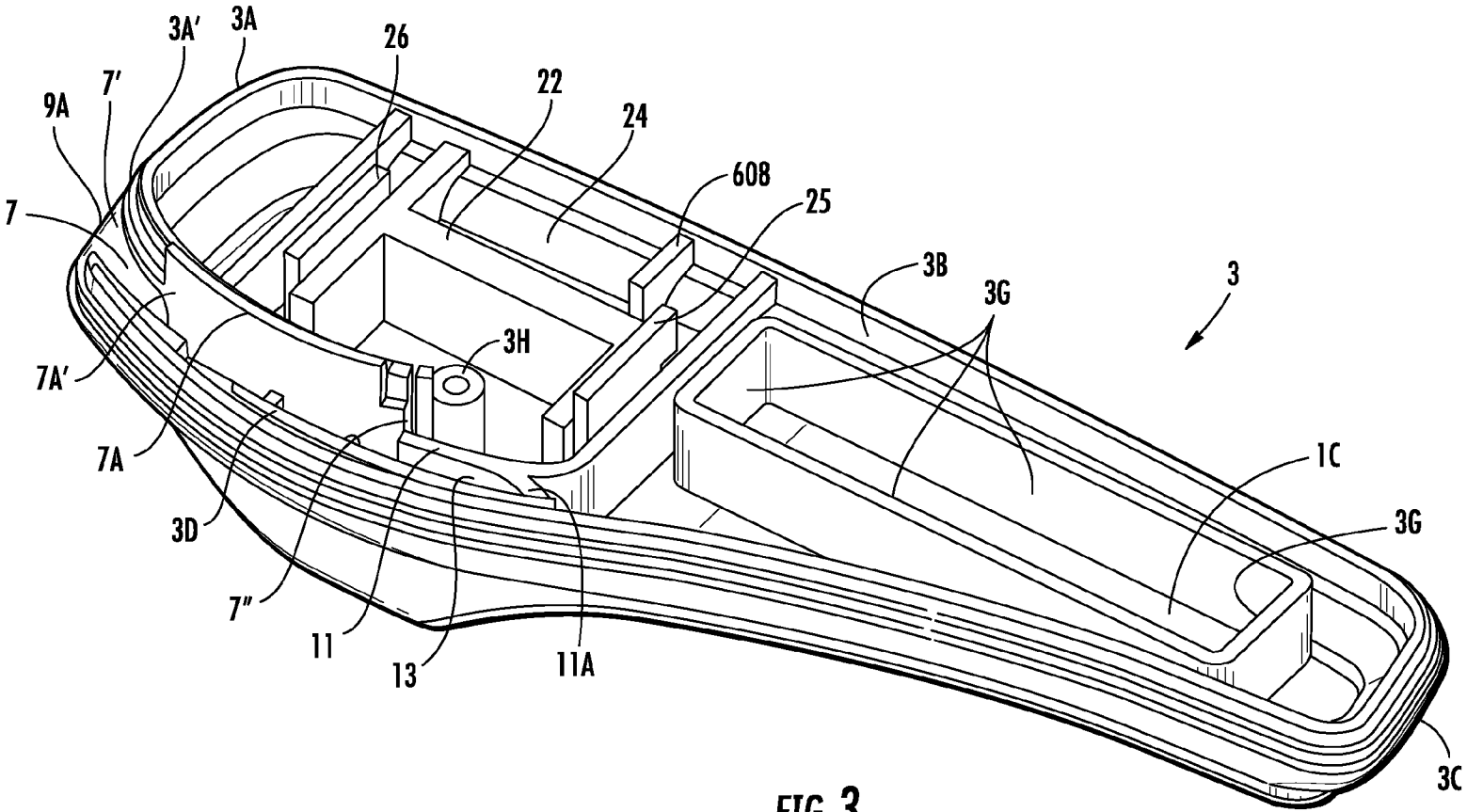
FIG. 3 illustrates a view of the interior of the lower housing of a security tag in accordance with one embodiment of the invention.
Figure 4B:
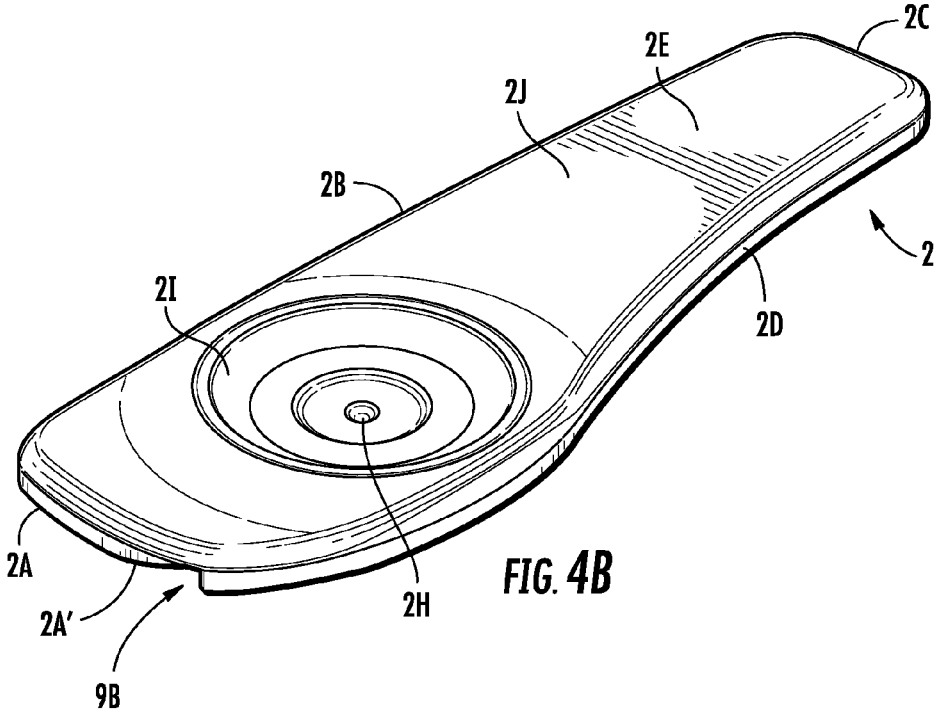
FIG. 4B illustrates a view of the exterior of the upper housing of a security tag in accordance with on embodiment of the invention.
Figure 4A:
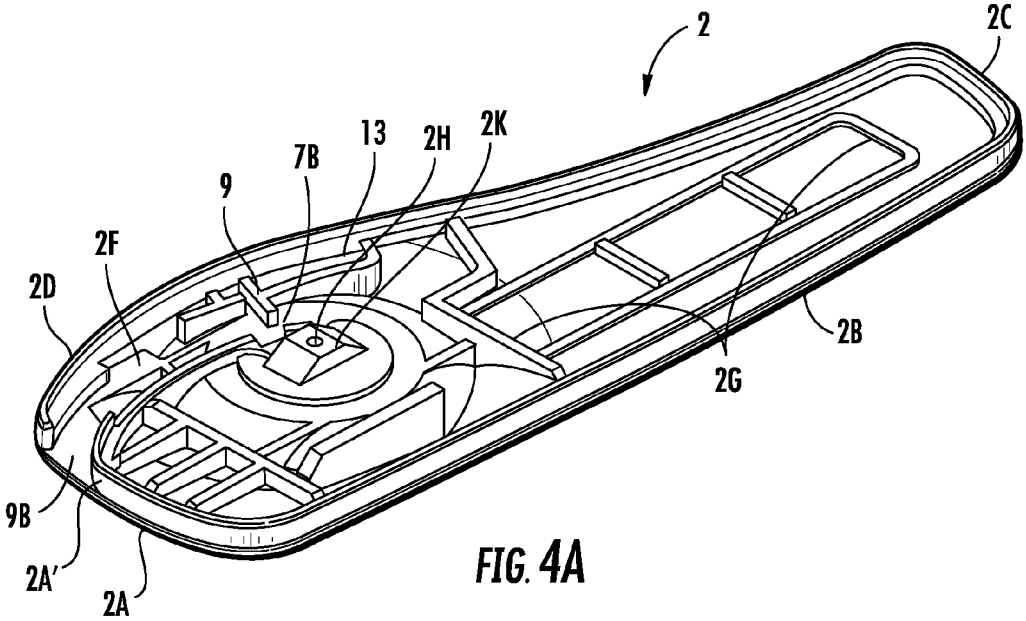
FIG. 4A illustrates a view of the interior of the upper housing of a security tag in accordance with one embodiment of the invention.

FIGS. 3, 4A and 4B illustrate the internal and external features for a body of security tag 1. More particularly, FIG. 3 illustrates a view of the interior of the lower housing of a security tag in accordance with one embodiment of the invention. FIG. 4A illustrates a view of the interior of the upper housing of a security tag in accordance with one embodiment of the invention. FIG. 4B illustrates a view of the exterior of the upper housing of a security tag in accordance with on embodiment of the invention. The features of FIGS. 3, 4A and 4B will be discussed in more detail below.

Referring again to FIG. 1, article 51 may be joined to tag body 1A by tack assembly 4. This may be accomplished by inserting tack body 4B into an opening 2H in the wall 2E of upper housing 2. When tack body 4B is fully inserted, an upstanding cavity or collar 3H extending from the inner surface 3F of the lower housing wall 3E may receive pointed end 4D of tack 4. The tack head 4A, in turn, seats in a recessed area 21 in the upper surface 2J of the wall 2E. Article 51 is thus held between the tack head 4A and the latter wall.

Figure 5:
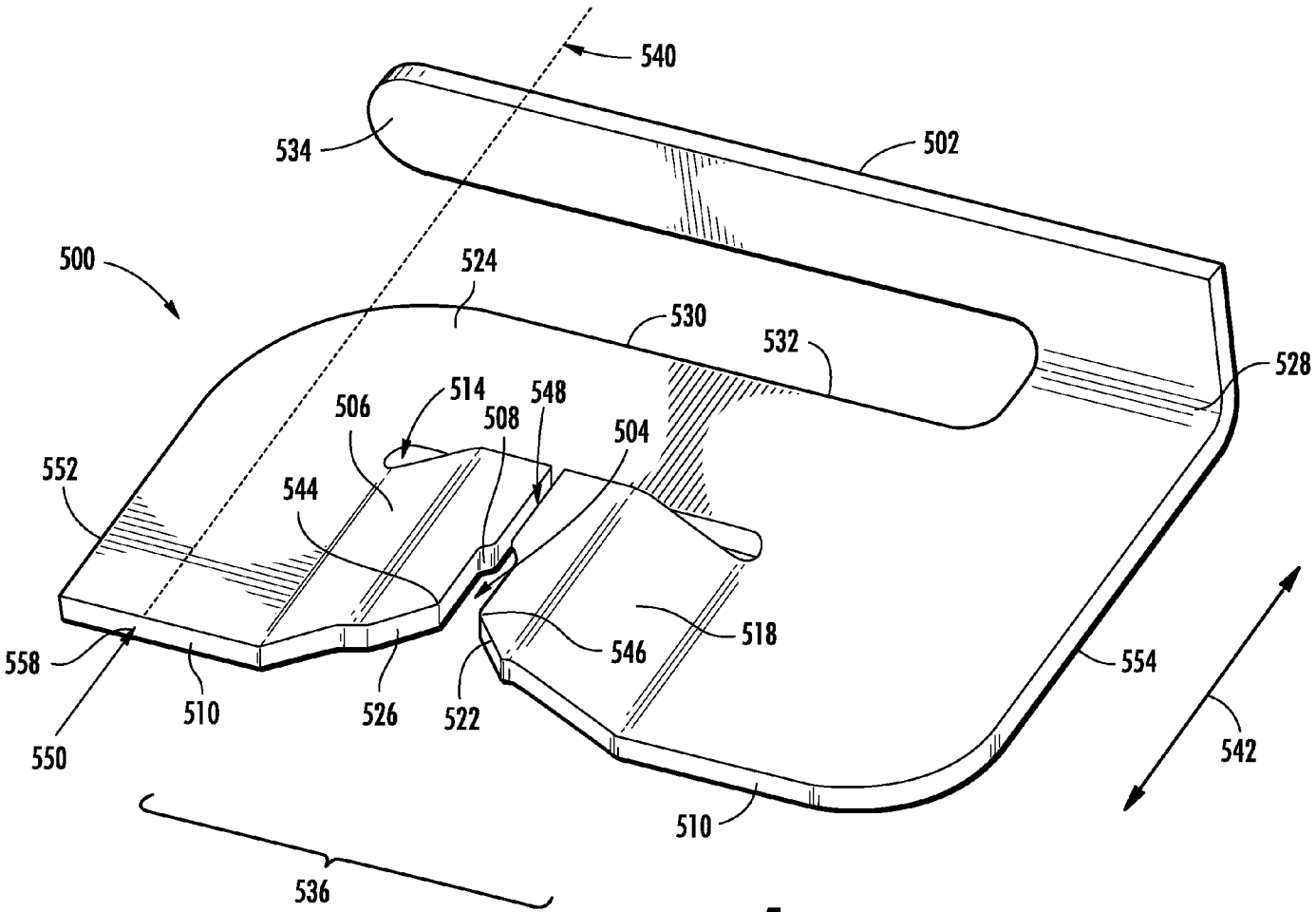
FIG. 5 illustrates an exploded view of a first linear clamp in accordance with one embodiment of the invention.

Security tag 1 may also include a linear clamp 500 as shown in FIG. 5. Linear clamp 500 may be disposed within tag body 1A for releasably preventing the tack body from being withdrawn from the tag body. Tack assembly 4 and article 51 thus become releasably locked to security tag 1 by linear clamp 500. Tack assembly 4 may be released from linear clamp 500 by moving it in a linear direction in response to a force. Linear clamp 500 will be discussed in greater detail with reference to FIG. 5 below.

In this embodiment, security tag 1 may be further adapted so that access to linear clamp 500 for releasing same is made difficult for other than authorized personnel. To this end, tag body 1A may be configured so that access to linear clamp 500 is through an arcuate channel 7, as shown in FIG. 3. Arcuate channel 7 may be a channel conforming to an arcuate probe 8. Arcuate channel 7 may be defined by any elements or structures, such as walls, posts or abutments, and the embodiments are not limited in this context. For example, arcuate channel 7 may be bordered by one or more inner walls and by parts of the side walls, as well as the upper and lower walls of tag body 1A. With this configuration, probe 8 conforming to arcuate channel 7 may be used to reach and release linear clamp 500 and, thus, detach tack assembly 4 and article 51 from tag body 1A.

As shown in FIG. 3, arcuate channel 7 may be bordered by a curved inner wall 7A. This wall extends upward from the inner surface 3F of the bottom housing 3 to abut the inner surface of an upper housing 2 security tag 1. The wall 7A is further spaced from the side wall 3D of the bottom housing 3, and its outward end 7A' terminates at an inward curved part 3A' of the side wall 3A. The inward curved part 3A' of the wall 3A results in a space or slot 9A between the side walls 3A and 3D of the lower housing 3.

Slot 9A cooperates with a similar slot 9B between side walls 2A and 2D of an upper housing 2 to define a second opening 9 for providing entry or access into the outward end 7' of the channel 7. At this entry point, side wall 2A also curves inwardly at a part 2A', the latter part 2A' mating with a curved side wall part 3A' of a side wall 3 of the lower housing 3.

Channel 7 may be further defined by a second curved wall 7B extending downwardly from an inner surface 2F of upper housing 2. Wall 7B may be situated outward of the inner end of curved wall 7A.

The presence of wall 7B may change or alter the configuration of channel 7 at its inner end 7" that lies adjacent to linear clamp 500. This change or alteration in configuration defines a keyway for channel 7 which may accommodate probe 8 to pass through channel 7 and gain access to linear clamp 500. In this case, wall 7B may change the channel cross section from substantially rectangular to substantially L-shaped, for example.

Adjacent inner end 7" of channel 7, lower housing 2 and upper housing 3 may further be provided with curved walls 9 and 11, which may terminate in wall sections 9A and 11A abutting the end walls 2D and 3D. Walls 9 and 11 are outward of channel 7 and, with the end walls 2D and 3D, define a trap area 13 that may prevent access to linear clamp 500. This area provides a safety measure for blocking unauthorized objects introduced into channel 7 of tag body 1A in an attempt reach linear clamp 500.

FIG. 5 is a view of a first linear clamp used in the security tag of FIG. 1 in accordance with one embodiment of the invention. FIG. 5 illustrates a linear clamp 500. As previously noted, linear clamp 500 may be adapted to releasably prevent tack body 4B from being withdrawn from tag body 1A. More particularly, in further accord with the embodiment, linear clamp 500 is specifically adapted to accommodate release of tack body 4B via arcuate probe 8 moving in arcuate channel 7.

In one embodiment, linear clamp 500 may release tack body 4B by moving in a linear direction. As previously defined, a linear direction may refer to movement in any particular direction along a substantially straight line, although the embodiments are not limited in this context. This may be contrasted with rotational movement around a pivot point, for example. In one embodiment, a linear direction is shown by line 542. The arrows at each end of line 542 indicate that linear clamp 500 may move along line 542 in either direction as desired for a particular application. Although line 542 is used by way of example, it can be appreciated that any linear direction may be used and still fall within the scope of the invention.

In one embodiment, linear clamp 500 may comprise a clamp body 524 and a tack retaining body 536. Tack retaining body 536 may be an integral part of clamp body 524. Tack retaining body 536 may comprise jaws 506 and 518. Jaws 506 and 518 each extend outwardly of the plane of the clamp body 524 and then inwardly toward the other jaw. Jaws 506 and 518, furthermore, terminate in facing edges 522 and 526. These edges extend from a common edge 510 of clamp body 524 inwardly toward each other to form a jaw open area, then curve outwardly away from each other to define a slot 504 for receiving tack body 4B. Edges 522 and 526 then continue in aligned fashion to form an elongated slot 548, and end in a slot 514 in clamp body 524.

In one embodiment, slot 504 may comprise a set of lines parallel to each other with a curve 508 at one end connecting the lines together. The width of slot 504 may be equal to, or slightly larger than, the diameter of tack groove 4C. The width should be sufficient so that linear clamp 500 may freely move in linear direction 542 with tack body 4B inserted. The width should also be sufficient, however, to prevent tack body 4B from being vertically withdrawn from jaws 506 and 518. The curve 508 may approximate the curve of tack body 4B or 4C, for example. Slot 504 may also have a release section as defined between points 544 and 546 allowing movement of a tack body from slot 504 to the jaw open area in response to linear movement of linear clamp 500.

In one embodiment, when the pointed end of tack body 4B is inserted into slot 504, jaws 506 and 518 may spread apart until a tack groove 4C aligns with jaws 506 and 518. This alignment allows jaws 506 and 518 to return to their original relaxed position and capture tack 4. Once jaws 506 and 518 capture tack 4 they resist extraction of tack 4 from slot 504, as discussed further below.

Figure 6:
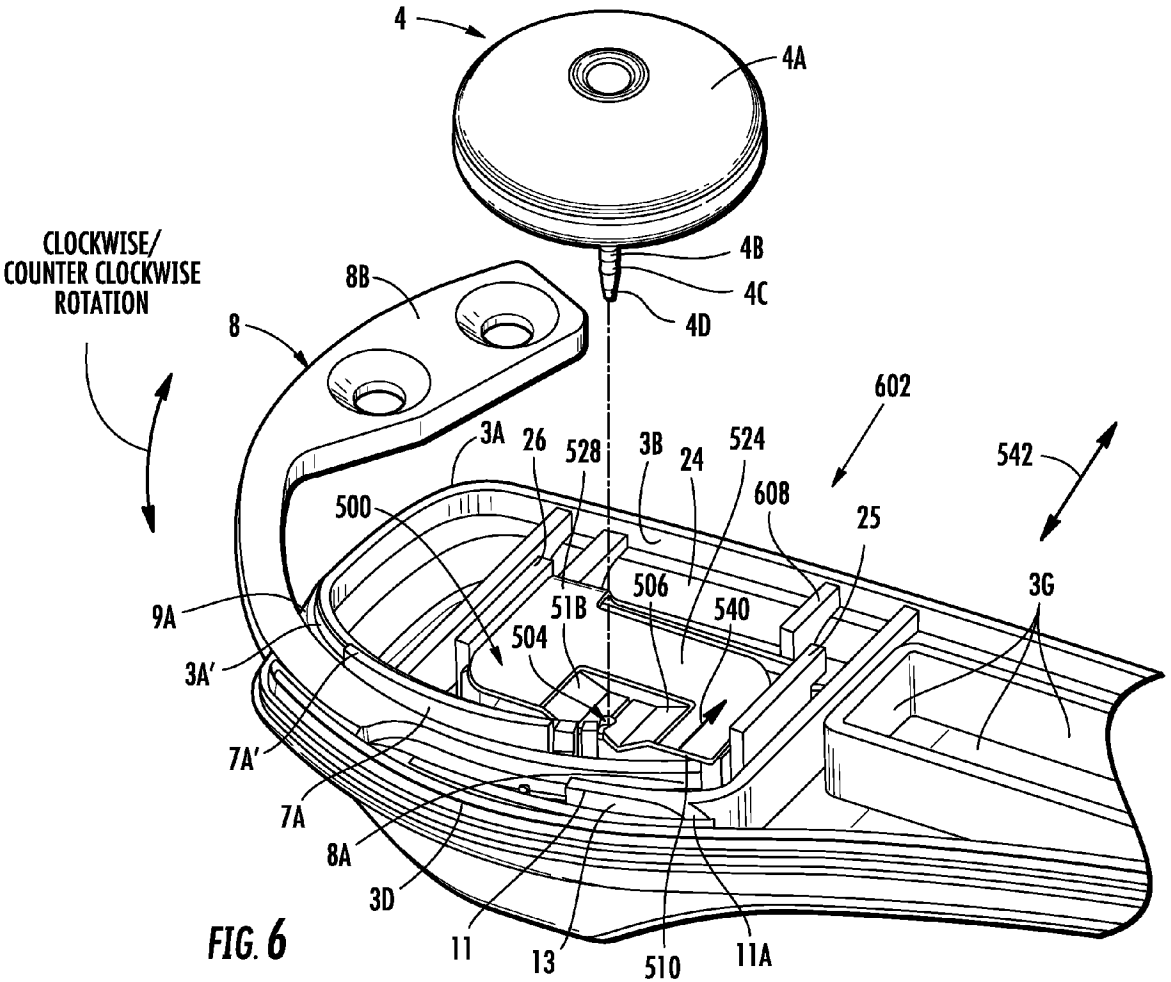
FIG. 6 illustrates a partial view of the interior of the lower housing of the security tag of FIG. 1 with a first linear clamp in accordance with one embodiment of the invention.

In one embodiment, an elongated spring arm 502 may be attached by a joint area 528 to a side 530 of an edge 532. Elongated spring arm 502 may extend along the length of edge 532 and is also out of the plane of clamp body 524. Elongated spring arm 502 may bias linear clamp 500 against one or more abutments to establish the initial position area. The abutment should be positioned along a line 540. Line 540 should be essentially parallel to the linear movements of clamp 500, as represented by line 542. The force applied by arcuate probe 8, as indicated by arrow 550, is applied at point 558, which is also positioned along line 540. An example of a possible abutment may be abutment 608 as shown in FIG. 6. It can be appreciated that as the line of force applied by arcuate probe 8 is relocated from the position shown in FIG. 6, the position of the abutment should move accordingly to stay approximately in line with the force.

FIG. 6 illustrates a partial view of the interior of the lower housing of the security tag of FIG. 1 with a first linear clamp in accordance with one embodiment of the invention. FIG. 6 illustrates linear clamp 500 disposed within lower housing 3. Upper housing 2 and lower housing 3 may have various structures to constrain movement of linear clamp 500 in all directions, except for movement in linear direction 542. The exact structures and amount of movement may vary according to various implementations, as discussed further below.

FIG. 6 may also illustrate a tack 4 being inserted into slot 504 of linear clamp 500. As discussed above, article 51 may be joined to tag body 1A by tack assembly 4. Pointed end 4D of tack body 4B may be introduced in the downward linear direction through an opening 2H in upper housing 2. Part 2K of upper housing 2 may be shaped to fit within the hollow of the spring clamp body 524 above jaws 506 and 518, and carries opening 2H. Part 2K may direct tack body 4B to slot 504 defined by facing edges 522 and 526 of the jaws. This may cause the jaws to spread or open and allow tack body 4B to pass through the jaws into slot 504.

When the downward tack travel is stopped at a desired slot 4C, e.g., a slot that secures tack head 4A and article 51 to wall 2E of upper housing 2, jaws 506 and 518 retract and clutch tack body 4B. In this position, jaws 506 and 518 prevent upward movement of tack 4. Tack 4 and article 51 thus become locked to tag body 1A.

In order to release tack 4 from tag body 1A, arcuate probe 8 is now introduced into channel 7 of tag body 1A until the L-shaped forward end 8A of probe 8 passes into the L-shaped inner end 7" of channel 7. This brings probe end 8A towards common edge 510 of clamp body 524. As probe end 8A provides force 550 to linear clamp 500 along line 540, linear clamp 500 moves in essentially direction 542 towards abutment 608. As linear clamp 500 moves along line 540, tack body 4B slides along slot 504 until it reaches the release section defined by points 544 and 546. As tack body 4B enters through the release section, it eventually moves into the jaw open area thereby releasing tack body 4B from the grip or clutch of the jaws. Tack 4 can now be moved in the upward linear direction past the jaws, via an upward force on tack head 4A, thereby withdrawing and separating tack body 4B from tag body 1A and article 51 from security tag 1.

In one embodiment, slot 504 may have a uniform width between both ends that provide very little, if any, resisting force by jaws 506 and 518 as tack body 4B slides along slot 504. The resistance to the motion of linear clamp 500 should be provided primarily by spring arm 502 as it is compressed by abutment 608. As mentioned previously, the contact point between abutment 608 and spring arm 502 should be approximately in line with the force provided by arcuate probe 8. In this manner, the resulting moments should be essentially zero, and the net motion of linear clamp 500 should be primarily in direction 542 with very little rotation.

During linear movement of linear clamp 500 as a result of the in-plane force exerted by probe 8, elongated spring arm 502 at joint area 528 is compressed. Spring arm 502 may be biased against abutment 608 as indicated by direction 602, which is approximately in line with the contact point of arcuate probe 8 and edge 510, and also in line with force applied along line 540 in direction 542. After tack 4 is separated from tag body 1A, probe 8 may be removed from channel 7. This disengages probe 8 from linear clamp 500 as it is withdrawn from channel 7. The force on linear clamp 500 is thus removed and elongated spring arm 502 expands. This causes linear clamp 500 to move in the opposite linear direction 542. Linear clamp 500 is thereby brought back to its original position awaiting reentry of tack body 4B for again attaching an article to security tag 1.

Lower housing 3 may have various guide interfaces to assist movement of linear clamp 500 in linear direction 542. In one embodiment, lower housing 3 may have a pair of guides 25 and 26 as shown in FIGS. 3 and 6. Guides 25 and 26 may assist in guiding linear clamp 500 in linear direction 542. The guides may be substantially rectangular structures each having a long edge contacting edges 552 and 554 of linear clamp 500. As force from arcuate probe 8 is applied to edge 510 of linear clamp 500 along line 540, linear clamp 500 begins moving in linear direction 542. Guides 25 and 26 assist such linear movement while constraining rotational or pivotal movement of linear clamp 500. Similarly, guides 25 and 26 may also assist in returning linear clamp 500 to the initial position in response to spring arm 502 returning to its initial position once force from arcuate probe 8 is removed.

It can be appreciated that other guide interfaces may be used to assist movement of linear clamp 500 in linear direction 542. For example, linear clamp 500 may have a set of slots formed in clamp body 524. The slots may be parallel to sides 552 and 554. The slots may also be designed to conform to corresponding guide rails formed in lower housing 3. The slot-rail interface may assist in moving linear clamp 500 in linear direction 542. In another example, lower housing 3 may have a pair of guide posts making contact against corresponding sides 552 and 554 of linear clamp 500. The guide posts may be positioned to limit rotational movement while emphasizing linear movement. In yet another example, linear clamp 500 may have flanges attached to sides 552 and 554, respectively. In this embodiment, lower housing 3 may have a pair of corresponding slots to accommodate the flanges, and allow the flanges to move in linear direction 542 while limiting rotational movement. The embodiments are not limited with respect to these and other structures to assist guiding linear clamp 500 in a linear direction.

The amount of linear movement for a particular implementation may vary depending upon several factors, such as the length of slot 504, the angles forming the jaw open area, the diameter of tack body 4B, and so forth. For example, the amount of linear movement may be slightly more than the diameter of tack body 4B, or approximately 0.05 inch, to release tack groove 4C into the jaw open area. In some instances, it may be desirable to have a greater amount of linear movement to ensure that tack body 4B does not substantially interfere with jaws 506 and 518 during vertical movement of tack 4, i.e., when withdrawn from tag body 1A. In one embodiment, for example, the initial position for linear clamp 500 is such that the probe at its maximum extension moves linear clamp 500 linearly between 0.045 and 0.065 inches against the bias of elongated spring arm 502, although the embodiments are not limited in this context.

Figure 7:
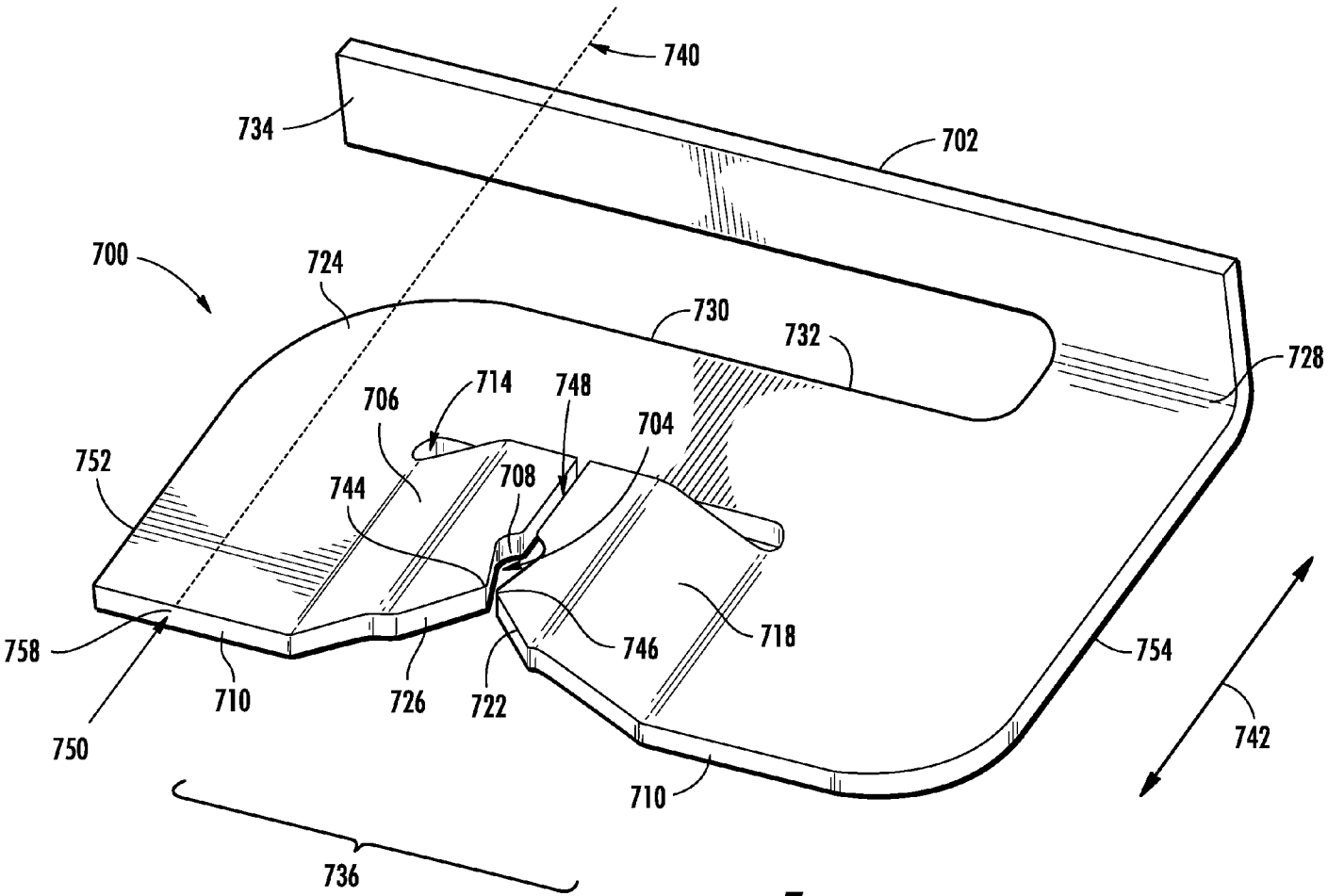
FIG. 7 illustrates an exploded view of a second linear clamp in accordance with one embodiment of the invention.

FIG. 7 illustrates an exploded view of a second linear clamp in accordance with one embodiment of the invention. FIG. 7 illustrates a second linear clamp 700. Second linear clamp 700 may be similar to, for example, first linear clamp 500. For example, elements 502, 506, 508, 510, 514, 518, 522, 524, 526, 528, 530, 532, 534, 536, 540, 542, 544, 546, 548, 550, 552, 554 and 558 of FIG. 5, may correspond to elements 702, 706, 708, 710, 714, 718, 722, 724, 726, 728, 730, 732, 734, 736, 740, 742, 744, 746, 748, 750, 752, 754 and 758 of FIG. 7.

In one embodiment, linear clamp 700 may include a slot 704. Slot 704 may have two ends. The first end may be defined as the end closest to curve 708 corresponding to tack body 4B. The second end may be defined as the end between release points 744 and 746. In one embodiment, a first width between the first end may be different from a second width between the second end. This may contrast with first linear clamp 500, where both ends have a uniform width to facilitate the movement of tack body 4B in slot 504, for example. More particularly, in one embodiment the width of the first end may be larger than the width of the second end. For example, the width between the walls forming slot 704 may narrow as they approach release points 744 and 746. Alternatively, the width between the walls forming slot 704 may be uniform until just before reaching release points 744 and 746, where the walls then turn in towards each other to narrow the width between release points 744 and 746. The actual difference between the widths may vary according to a number of factors, such as diameter of tack groove 4C, the amount of desired resistance for movement of tack body 4B through slot 704, the length of slot 704, the anticipated linear motion, and so forth. The embodiments are not limited in this context.

Figure 8:
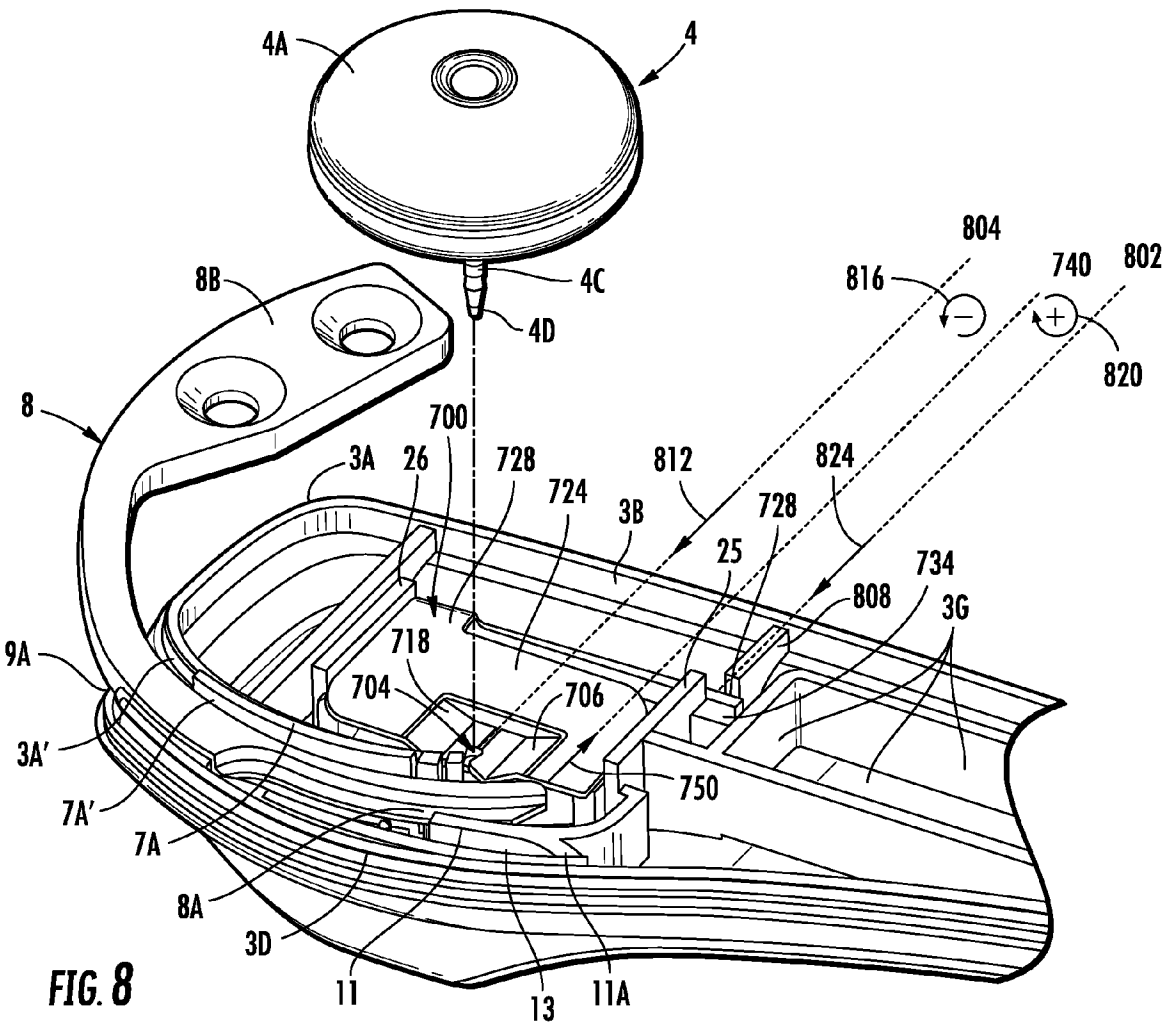
FIG. 8 illustrates a partial view of the interior of the lower housing of the security tag of FIG. 1 with a second linear clamp in accordance with one embodiment of the invention.

FIG. 8 illustrates a partial view of the interior of the lower housing of the security tag of FIG. 1 with a second linear clamp in accordance with one embodiment of the invention. FIG. 8 illustrates second linear clamp 700 disposed within lower housing 3. Clamp body 724 may be supported by various support walls in lower housing 3. For example, in one embodiment linear clamp 700 is constrained by a guide 25, a guide 26 and an abutment 808. The supports help define the direction and amount of linear movement for linear clamp 700. Elongated spring arm 702 may rest with one end 734 against abutment 808 and guide 25, for example, as shown in FIG. 8.

FIG. 8 may also illustrate a tack 4 being inserted into slot 704 of linear clamp 700. Tack 4 may be captured by linear clamp 700 in a manner similar to the manner described with reference to FIG. 6. The release operation, however, may differ due in part to the configuration of slot 704, as discussed in more detail below.

During the detachment process, arcuate probe 8 may be introduced into channel 7 of tag body 1A until probe end 8A contacts common edge 710 of clamp body 724. As probe end 8A provides force 750 to linear clamp 700 along line 740, linear clamp 700 may move substantially in direction 742 towards abutment 808. As previously described, slot 704 may have two widths as discussed previously with reference to FIG. 7. The first width may be equal to, or slightly larger than, the diameter of tack groove 4C. The second width may be decreased until it is slightly smaller such that the distance between release points 744 and 746 is slightly less than the diameter of tack groove 4C. This may create interference between slot 704 and tack groove 4C as linear clamp 700 moves substantially along line 740. A resisting force 812 is created by release points 744 and 746 as they must be spread apart to transverse past tack groove 4C. Resisting force 812 combined with the force 750 from arcuate probe 8 may create a counterclockwise moment 816 as shown in FIG. 8. A resistive force 824 from spring arm 702 is located at the point of contact 828 with lower housing 3. Locating contact point 828 on spring arm 702 towards end 734 may generate a resistive moment 820 in the clockwise direction. Consequently, contact point 828 should be positioned to generate a clockwise moment 820 approximately equal and opposite to counterclockwise moment 816 caused by the narrowing of slot 704. Accordingly, the net rotary forces may remain approximately zero. Hence, the force from arcuate probe 8 produces a substantially linear movement by linear clamp 700 in linear direction 742. The amount of movement in a linear direction may be subject to the same variables as discussed previously with reference to FIGS. 5 and 6. As tack body 4B enters through the release section, it eventually moves into the jaw open area thereby releasing tack body 4B from the grip or clutch of the jaws. Tack 4 can now be moved in the upward linear direction past the jaws, via an upward force on tack head 4A, thereby withdrawing and separating tack body 4B from tag body 1A and article 51 from security tag 1.

In one embodiment, contact point 828 may be between abutment 808 and spring arm 702 as shown in FIG. 8. It is worthy to note that the placement of abutment 808 is to convey movement of the contact point towards end 734 to compensate for resistive force 812 caused by slot 704, as indicated by line 804. The actual length of spring arm 702 and the positioning of abutment 808 may be dependent upon the amount of resistive force created by slot 704 for a given implementation, and the embodiments are not limited in this context.

During linear movement of clamp body 724 as a result of the in-plane force exerted by probe 8, elongated spring arm 702 at joint area 728 is compressed. Spring arm 702 may compress against abutment 708 until tack body 4B is released. After tack 4 is separated from tag body 1A, probe 8 is removed from channel 7. This disengages probe 8 from clamp body 724 as it is withdrawn from channel 7. The force on linear clamp 700 is thus removed and elongated spring arm 702 expands. This causes linear clamp 700 to move in the opposite linear direction 742. Movement in linear direction 742 may be assisted by guides 25 and 26, as discussed previously. Linear clamp 700 is thereby brought back to its original position awaiting reentry of tack body 4B for again attaching an article to security tag 1.

It should be noted that in some implementations some slight rotation may still occur, but the primary motion should remain in a linear direction 742. Further, it may be appreciated that once tack body 4B is released into the jaw open area, the resisting force of jaws 706 and 718 will disappear. The remaining forces would be the force from arcuate probe 8 and the resisting force from spring arm 702. Consequently, any further motion of linear clamp 700 may tend to be rotary in a clockwise direction. This motion should be inconsequential to the operation of security tag 1, however, since tack 4 should already be released from linear clamp 700.

Figure 9:
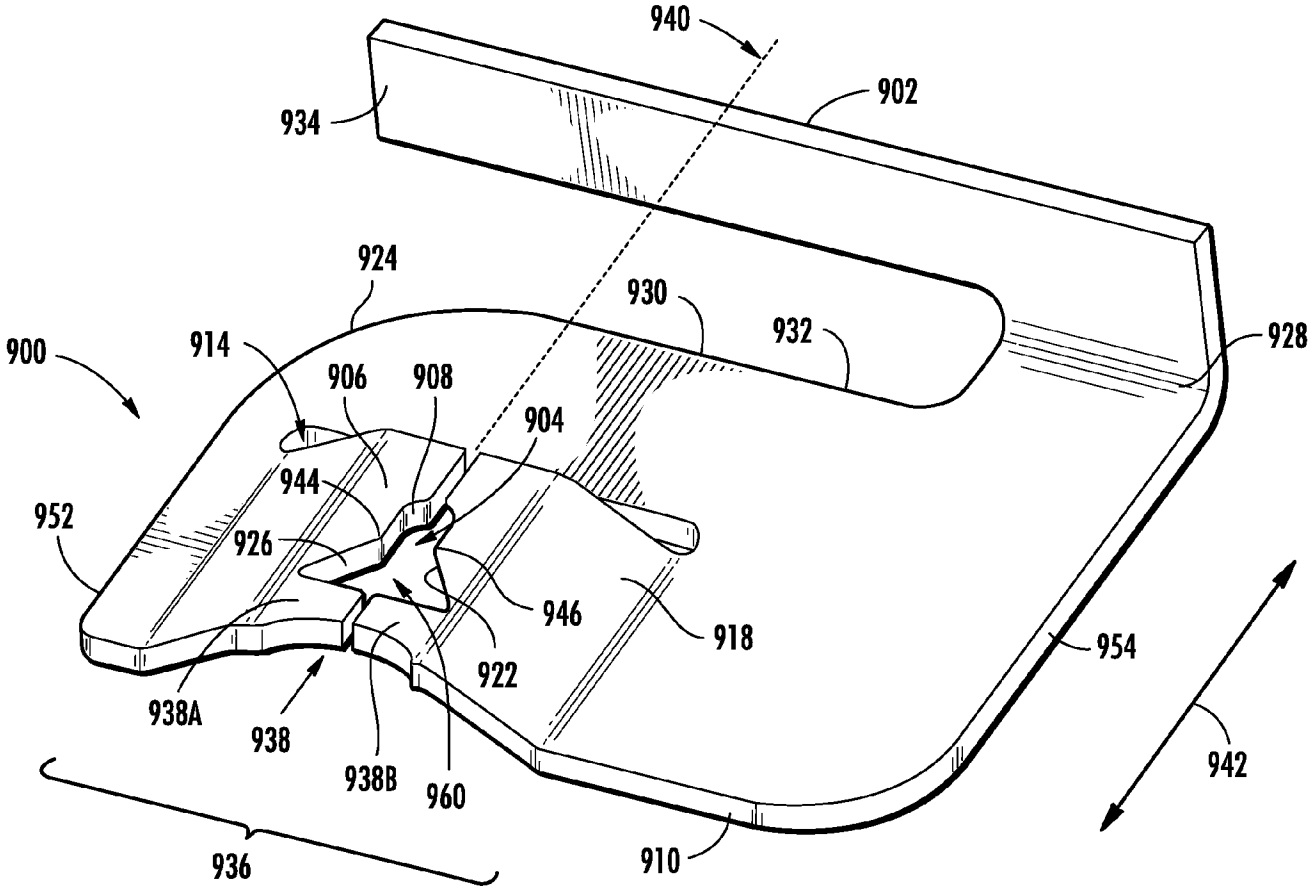
FIG. 9 illustrates an exploded view of a third linear clamp used in the security tag of FIG. 1 in accordance with one embodiment of the invention.

FIG. 9 illustrates an exploded view of a third linear clamp used in the security tag of FIG. 1 in accordance with one embodiment of the invention. FIG. 9 illustrates a third linear clamp 900. Third linear clamp 900 is similar in structure, constraints, supports, positioning and operation as first linear clamp 500. More particularly, elements 502, 504, 506, 508, 510, 512, 514, 516, 518, 520, 522, 524, 526, 528, 530, 532, 534, 536, 540, 542, 544, 546, 548, 550, 552 and 554 correspond to elements 902, 904, 906, 908, 910, 912, 914, 916, 918, 920, 922, 924, 926, 928, 930, 932, 934, 936, 940, 942, 944, 946, 948, 950, 952 and 954, respectively.

In one embodiment, third linear clamp 900 may also include a bridge 938. Bridge 938 may be a section of material placed across the jaw open area 960. Bridge 938 may be implemented in a number of ways to obtain sufficient jaw open area size and bridge strength for a given application. The particular bridge solution may vary depending upon a number of factors, such as the distance between the jaws, the size of the jaw open area, the type and flexibility of the material, contact surface of the probe, shape of the bridge, and so forth. The shape of the bridge may be, for example, any desired shape, such as straight, contoured, concave, convex, and so forth. For a given implementation of bridge 938, jaw open area 960 should be large enough not to interfere with tack body 4B when probe 8 is at maximum extension. This has the advantage of assuring substantially one point of contact with any added interface elements or the bridge. In some cases, the point of contact should be along a line through the approximate center of bridge 938.

In one embodiment, bridge 938 may be divided into two bridge sections 938A and 938B. Atone end, bridge sections 938A and 938B may be attached to jaws 906 and 918, respectively. At the other end, bridge sections 938A and 938B have spaced facing edges. This may result in bridge 938 having a narrow gap through its center, perpendicular to slot 914 along line 940. In another embodiment, bridge 938 may be a solid piece of material connecting jaws 922 and 926. The embodiments are not limited in this context.

Figure 10:
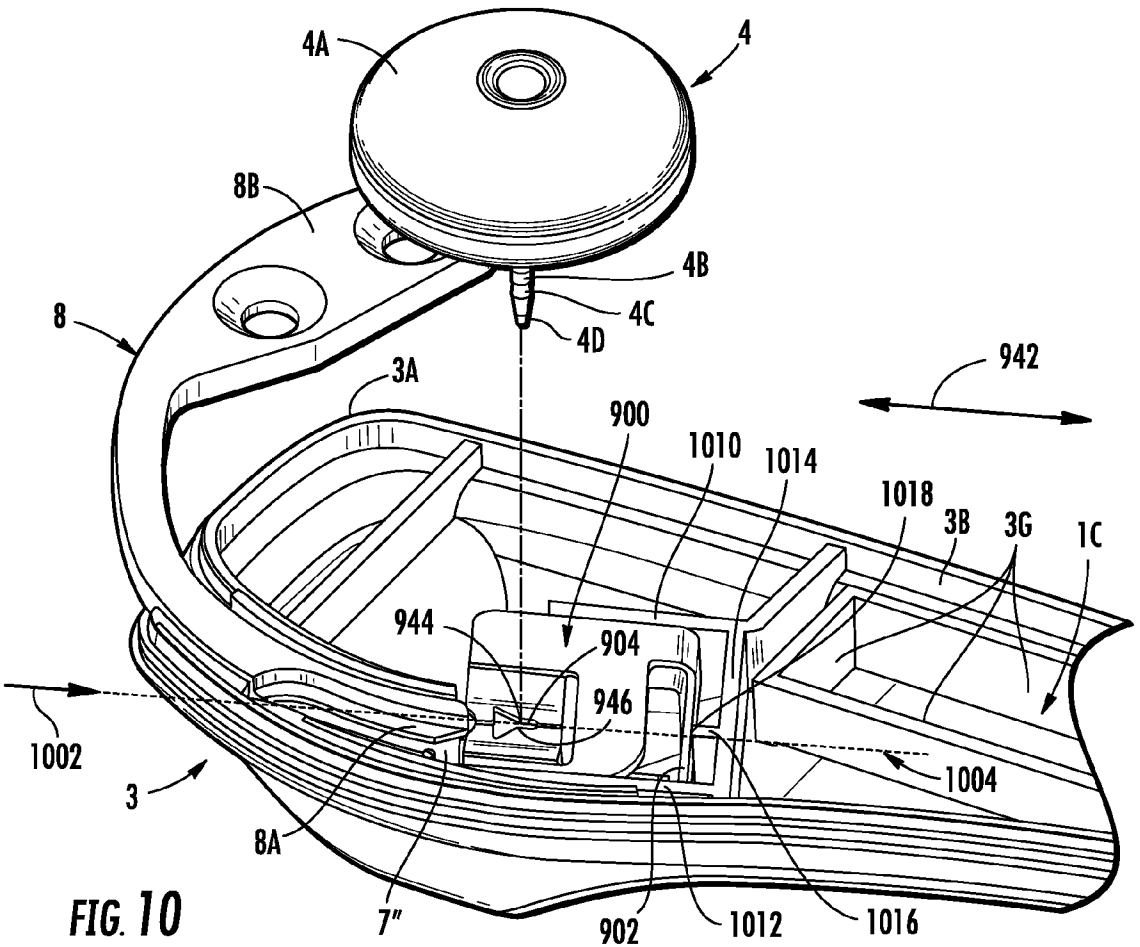
FIG. 10 illustrates a view of a detaching arm, the interior of the lower housing of the security tag of FIG. 1, and a third linear clamp, in accordance with one embodiment of the invention.

FIG. 10 illustrates a view of a detaching arm, the interior of the lower housing of the security tag of FIG. 1, and a third linear clamp, in accordance with one embodiment of the invention. FIG. 10 illustrates a third linear clamp 900 disposed within a modified lower housing 3. In one embodiment, modified lower housing 3 may relocate the position of third linear clamp 900 relative to the previous embodiments. The new position may allow probe end 8A to contact bridge 938 along line 1004. The force from probe 8 along line 1004 may move third linear clamp 900 in linear direction 942.

More particularly, modified lower housing 3 may include guides 1010 and 1012. Guides 1010 and 1012 may perform a similar function to guides 25 and 26. Guides 1010 and 1012 may assist guiding third linear clamp 900 in linear direction 942 in response to force provided by arcuate probe 8.

Modified lower housing 3 may further comprise wall 1014. Wall 1014 may further comprise an abutment 1016. Wall 1014 and abutment 1016 may assist in limiting the amount of movement in linear direction 942. Further, abutment 1016 may make contact with spring arm 902 along line 940 of third linear clamp 900 to bias spring arm 902 as third linear clamp 900 moves in linear direction 942.

Modified lower housing 3 may also relocate collar 3H to receive tack end 4D of tack 4 when in the fastened position. Adjustments to tack 4 may also be needed to accommodate the new position of collar 3H, depending upon the particular implementation. For example, the length of tack 4 may be adjusted to ensure proper seating in collar 3H when fully inserted.

Other adjustments may be needed for modified lower housing 3 to accommodate the new position of third linear clamp 900. For example, inner surface 3F of wall 3E of housing 3 may have frame members 3G which together define an interior cavity 1C for receiving EAS sensor 5. Frame members 3G may be repositioned towards wall 3B, for example.

In addition to the modifications to modified lower housing 3, upper housing 2 may be similarly modified to correspond to the modifications of modified lower housing 3. For example, opening 2H in wall 2E of modified upper housing 2 may be relocated to correspond to collar 3H of modified lower housing 3. In another example, recessed area 21 in upper surface 2J of wall 2E may be relocated to ensure that tack head 4A properly seats in recessed area 21 when fully inserted through opening 2H.

Other modifications for modified upper housing 2, modified lower housing 3, and tack 4 may be needed for a particular implementation. It can be appreciated that the embodiments are not limited in this context.

In one embodiment, the same detaching device having a probe 8 may be used with security tag 1. In another embodiment, a different detaching device may be needed to accommodate the new position of linear clamp 900. In the latter case, the radius of the probe should be configured to pass through arcuate channel 7. Probe end 8A or the cross-section of the probe may be modified as desired for a particular implementation.

In one embodiment, the new initial position for linear clamp 900 centers bridge 938 towards inner end 7" of channel 7. When probe 8 is inserted into channel 7, the end of probe 8 may move along channel 7 and apply force directly upon bridge 938 along line 1004. Line 1004 may proceed from the point of contact, through the slot and to a spring arm contact point 1018, for example. This may contrast with previous embodiments, where the contact point between probe end 8A and the linear clamp was toward one end of the linear clamp. Having the line of action of force 1002 from probe 8 going through the slot produces essentially zero moment. Thus motion is substantially linear. The force may move third linear clamp 900 through guides 1010 and 1012 in linear direction 942. The linear movement may cause tack groove 4C to move from slot 904 through release points 944 and 946 into jaw open area 960. The new initial position is such that when probe 8 is at its maximum extension, linear clamp 900 may move between 0.045 and 0.065 inches against spring arm contact point 1018, although the embodiments are not limited in this context. It is worthy to note that abutment 1016 biasing spring arm 902 should be repositioned along line 1004, as shown in FIG. 10. When probe 8 is withdrawn, elongated spring arm 902 pushes linear clamp 900 back to its new initial position.

Since arcuate probe 8 travels along an arc, the contact point with third linear clamp 900 will move slightly as third linear clamp 900 moves to release tack body 4B. The magnitude of the moment may be reduced by centering the range of contact points about the point of zero moment. In this manner, the resolution of forces at the beginning of travel will have a slight clockwise component, that will decrease and move towards zero at the center of travel, and increase to have a slight counterclockwise component for the final portion of the travel. The net motion may be essentially translation. Slight deviations from this theoretical geometry may result in a small amount of net rotation. The effect of translation will be much greater, however, and the translation may be in the primary motion that allows release of tack body 4B. Optimizing the shape of the contact surface of third linear clamp 900 may further reduce the range of contact points. As shown in FIG. 10, third linear clamp 900 may have a concave shape to reduce the contact range.

While certain features of the embodiments of the invention have been illustrated as described herein, many modifications, substitutions, changes and equivalents will now occur to those skilled in the art. It is, therefore, to be understood that the appended claims are intended to cover all such modifications and changes as fall within the true spirit of the embodiments of the invention.

The invention claimed is:

1. A security tag, comprising a tag housing;

a tack body;

a linear clamp disposed within said tag housing, the linear clamp including a spring arm to bias the linear clamp against one or more abutments, the linear clamp further including a slot with a slot length to retain said tack body, the linear clamp to move in a substantially linear direction along said slot length in response to a force to release said tack body from said slot, the linear clamp further including a tack retaining body to retain said tack body, wherein said tack retaining body comprises a first jaw and a second jaw, with each jaw terminating in spaced facing edges, said spaced facing edges forming said slot and a jaw open area in a clamp body; and a bridge across said jaw open area.

2. The security tag of claim 1, wherein said linear clamp further comprises:

said clamp body; and said spring arm attached to a first edge of said clamp body.

3. The security tag of claim 2, wherein said spring arm comprises: a spring arm body that extends along said first edge of said clamp body; and a curved joint joining said spring arm body to one end of said clamp body.

4. The security tag of claim 2, wherein said spring arm moves from a first position to a second position in response to said force, and moves from said second position to said first position when said force terminates.

5. The security tag of claim 1, wherein said jaws extend from a common second edge of said clamp body.

6. The security tag of claim 1, wherein said jaws are integrally formed with said clamp body.

7. The security tag of claim 1, wherein said tack body comprises at least one first portion and at least one second portion, said first and second portions having first and second diameters, respectively, with said second diameter smaller than said first diameter.

8. The security tag of claim 7, wherein said slot has a width approximate to said second diameter, wherein said jaws move from a first position to a second position to accommodate said first portions, and from second position to said first position to retain said second portions.

9. The security tag of claim 1, wherein a side of said clamp body forms a first plane, and a side of said tack retaining body forms a second plane substantially parallel to said first plane.

10. The security tag of claim 1, wherein a first portion of said spaced facing edges are substantially parallel to form said slot, with a first end of said slot forming a curve approximating a curve for said tack body, and said second end of said slot forming a release section opening into said jaw open area.

11. The security tag of claim 10, wherein a tag body includes a channel for a detachment probe, said channel configured to accommodate movement of said detachment probe to contact a second edge of said linear clamp.

12. The security tag of claim 11, wherein said detachment probe provides force against said second edge of said linear clamp to move said linear clamp from a first position to a second position in said linear direction.

13. The security tag of claim 12, wherein said linear clamp moves from said second position to said first position when said force is terminated.

14. The security tag of claim 1, wherein a second portion of said spaced facing edges are straight to form said jaw open area, with a first distance between the first jaw and the second jaw at a first end of said jaw open area being less than a second distance between the first jaw and the second jaw at a second end of said jaw open area.

15. The security tag of claim 1, wherein said tag housing comprises a top half and a bottom half, with said bottom half having a guide to assist movement of said linear clamp in said linear direction.

16. The security tag of claim 15, wherein said bottom half includes the abutment, said abutment being disposed approximately in line with said force.

17. The security tag of claim 1, wherein a tag body includes a channel for a detachment probe, said channel configured to accommodate movement of said detachment probe to contact said bridge.

18. The security tag of claim 17, wherein said detachment probe provides force against said bridge to move said linear clamp from a first position to a second position in said linear direction.

19. The security tag of claim 18, wherein said linear clamp moves from said second position to said first position when said force is terminated.

20. The security tag of claim 1, wherein a first portion of said spaced facing edges are substantially straight to form said slot, with a first end of said slot having a first width and forming a curve approximating a curve for said tack body, and a second end of said slot forming a release section opening into said jaw open area, with said release section having a second width smaller than said first width.

21. The security tag of claim 20, wherein said tag housing comprises a top half and a bottom half, with said bottom half having a guide to assist movement of said linear clamp in said linear direction.

22. The security tag of claim 21, wherein said bottom half includes the abutment, the abutment being disposed to generate a clockwise moment approximately equal and opposite to a counterclockwise moment caused by said slot.

23. A linear clamp for a security tag, comprising:

a clamp body;

a spring arm attached to a first edge of said clamp body to bias the linear clamp against one or more abutments;

a tack retaining body having a slot with a slot length to retain a tack body, and to release said tack body from said slot in response to a force applied in a substantially linear direction along said slot length, wherein said tack retaining body comprises a first jaw and a second jaw, with each jaw terminating in spaced facing edges, said spaced facing edges forming said slot and a jaw open area in said clamp body; and a bridge across said jaw open area.

24. The linear clamp of claim 23, wherein said jaws extend from a common second edge of said clamp body.

25. The linear clamp of claim 23, wherein said jaws are integrally formed with said clamp body.

26. The linear clamp of claim 23, wherein a side of said clamp body forms a first plane, and a side of said tack retaining body forms a second plane substantially parallel to said first plane.

27. The linear clamp of claim 23, wherein a first portion of said spaced facing edges are substantially parallel to form said slot, with a first end of said slot forming a curve approximating a curve for said tack body, and said second end of said slot forming a release section opening into said jaw open area.

28. The linear clamp of claim 23, wherein a second edge of said tack retaining body receives force to move said linear clamp from a first position to a second position in said linear direction.

29. The linear clamp of claim 28, wherein said tack body moves into said jaw open area when said linear clamp is in said second position, thereby releasing said tack body from said tack retaining body.

30. The linear clamp of claim 29, wherein said linear clamp moves from said second position to said first position when said force is terminated.

31. The linear clamp of claim 28, wherein said spring arm comprises: a spring arm body that extends along said first edge of said clamp body; and a curved joint joining said spring arm body to one end of said clamp body.

32. The linear clamp of claim 31, wherein said spring arm moves from a first position to a second position in response to said force, and moves from said second position to said first position when said force terminates.

33. The linear clamp of claim 32, wherein said spring arm is biased approximately in line with said force.

34. The linear clamp of claim 23, wherein a second portion of said spaced facing edges are straight to form said jaw open area, with a first distance between the first jaw and the second jaw at a first end of said jaw open area being less than a second distance between the first jaw and the second jaw at a second end of said jaw open area.

35. The linear clamp of claim 23, wherein said bridge receives force to move said linear clamp from a first position to a second position in said linear direction.

36. The linear clamp of claim 35, wherein said tack body moves into said jaw open area when said linear clamp is in said second position, thereby releasing said tack body from said tack retaining body.

37. The linear clamp of claim 36, wherein said linear clamp moves from said second position to said first position when said force is terminated.

38. The linear clamp of claim 23, wherein a first portion of said spaced facing edges are substantially straight to form said slot, with a first end of said slot having a first width and forming a curve approximating a curve for said tack body, and a second end of said slot forming a release section opening into said jaw open area, with said release section having a second width smaller than said first width.

39. The linear clamp of claim 38, wherein a second edge of said tack retaining body receives force to move said linear clamp from a first position to a second position in said linear direction.

40. The linear clamp of claim 39, wherein said tack body moves into said jaw open area when said linear clamp is in said second position, thereby releasing said tack body from said tack retaining body.

41. The linear clamp of claim 40, wherein said linear clamp moves from said second position to said first position when said force is terminated.

42. The linear clamp of claim 38, wherein said spring arm comprises: a spring arm body that extends along said first edge of said clamp body; and a curved joint joining said spring arm body to one end of said clamp body.

43. The linear clamp of claim 42, wherein said spring arm moves from a first position to a second position in response to said force, and moves from said second position to said first position when said force terminates.

44. The linear clamp of claim 43, wherein said spring arm is biased to generate a clockwise moment approximately equal and opposite to a counterclockwise moment caused by said slot.

* * * * *